United States Patent [19]

Ishibe et al.

[11] 3,944,532

[45] Mar. 16, 1976

[54] NOVEL RESINS AND MANUFACTURING THE SAME

[75] Inventors: Shuhei Ishibe, Nara; Toshiharu Okumichi, Amagasaki; Keizo Matsumoto, Osaka, all of Japan

[73] Assignee: Arkawa Rinsan Kagaku Kogyo Kabushiki Kaisha, Osaka, Japan

[22] Filed: Mar. 11, 1974

[21] Appl. No.: 449,731

[30] Foreign Application Priority Data

| | | |
|---|---|---|
| Mar. 12, 1973 | Japan | 48-29265 |
| Mar. 30, 1973 | Japan | 48-36936 |
| Mar. 30, 1973 | Japan | 48-36937 |

[52] U.S. Cl. ..... 260/89.3; 162/168 N; 260/29.6 R; 260/80 P; 260/88.7 A; 260/89.7 R; 260/89.2; 260/89.3

[51] Int. Cl.[2] ..... C08F 120/04; C08F 120/50; C08F 120/12; C08F 120/54

[58] Field of Search ..... 260/89.3, 93.1, 82, 86.1, 260/85.5 R, 85.5 A, 80 P, 80 A, 89.7 R

[56] References Cited

UNITED STATES PATENTS

| | | | |
|---|---|---|---|
| 3,554,886 | 1/1971 | Colomb et al. | 260/89.3 |
| 3,836,509 | 9/1974 | Colomb et al. | 260/89.3 |

*Primary Examiner*—Harry Wong, Jr.
*Attorney, Agent, or Firm*—Jordan B. Bierman; Linda Bierman; Kenneth J. Stempler

[57] ABSTRACT

A process for manufacturing a novel resin which comprises reacting, in the presence of a Friedel-Crafts catalyst, an aliphatic monovalent alcohol with a Diels-Alder addition product, the product being at least one compound having the formula

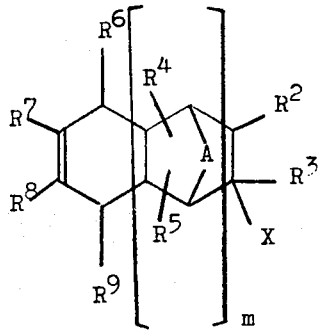

or

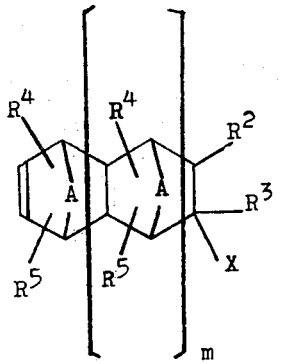

wherein each of $R^2$, $R^3$, $R^4$ and $R^5$ is a hydrogen atom or methyl group, each of $R^6$, $R^7$, $R^8$ and $R^9$ is a hydrogen atom or alkyl group having 1 to 4 carbon atoms, X is —COOH, —$COOR^a$, —CN or $CONH_2$, $R^a$ being an alkyl group having 1 to 4 carbon atoms, A is —$CH_2$— or —$CH_2CH_2$—, and *m* is an integer of 1 or 2.

25 Claims, No Drawings

NOVEL RESINS AND MANUFACTURING THE SAME

This invention relates to novel resins and a method for producing the same. Further, the invention relates to compositions useful as sizing agents for paper and emulsifiers for the emulsion polymerization of synthetic rubbers.

Conventionally, rosin and its derivatives have been employed not only as emulsifiers for synthetic rubbers and sizing agents for paper making but also as tackifiers for pressure-sensitive adhesives, hotmelt compositions and various rubbers and as resins for coating compositions and printing inks.

For example, alkali salts of the rosin derivative obtained by the disproportionation or hydrogenation of rosin to make the conjugated double bonds inactive are extensively used as emulsifiers for emulsion polymerization in producing styrene-butadiene rubber, acrylonitrile-butadiene-styrene rubber and like synthetic rubbers. This derivative is capable of the polymerization reaction and improving the processability of the resulting synthetic rubbers and their tackiness.

Furthermore, when an alkali salt of rosin or rosin derivative such as fortified rosin is added in a small amount to a pulp suspension in paper making process, it imparts good writing properties and sizing effects to the finished paper. Thus rosin and its derivatives are widely used as an essential additive in the paper making industry.

Rosin has further properties of being soluble in many kinds of solvents and compatible with various high polymers. The softening point of rosin can be varied as desired and its compatibility with various materials can be improved by modification with metal compounds, alcohols, polybasic acids, phenolic resins, etc. Moreover, when mixed with other materials, rosin imparts tackiness to the materials. Accordingly, rosin or its derivatives are used extensively as tackifiers for pressure sensitive adhesives, hotmelt compositions and various rubbers and also as resins for coating compositions, printing inks, road marking compositions and floor tiles.

Because of these outstanding properties exhibited in a wide variety of applications, rosin is very useful as an industrial material. However, since it is a naturally occurring material, its supply is not stable and there is no possibility of increased production. Accordingly, it has become an important problem to synthesize resins having properties similar to those of rosin and its derivatives.

A main object of the invention is to provide a novel-like resin having properties and characteristics similar to those of rosin and its derivatives and usable as a substitute for rosin as well as derivatives thereof.

Another object of the invention is to provide a process for manufacturing a rosin-like resin having the above properties and characteristics from materials easily available on a commercial scale.

Another object of the invention is to provide a composition containing a novel resins which can be used for a wide variety of purposes as substitutes for compositions containing rosin or its derivatives, such as emulsifiers for producing synthetic rubber by emulsion polymerization, sizing compositions for paper, pressure-sensitive adhesives, hotmelt adhesives, coating compositions, printing inks and the like.

Another object of the invention is to provide a sizing composition for paper, which displays excellent sizing effect as compared not only with conventional rosin sizes but also with fortified rosin sizes.

Another object of the invention is to provide an emulsifying composition for producing synthetic rubber by emulsion polymerization, which is similar to or superior to conventional emulsifiers containing modified rosins.

These and other advantages and objects of the present invention will be apparent from the following description.

According to this invention the desired resin is prepared by reacting, in the presence of a Friedel-Crafts catalyst, a Diels-Alder addition product with an aliphatic alcohol having the formula as $$R^1OH \qquad (I)$$

wherein $R^1$ is an aliphatic straight-chain or branched-chain hydrocarbon group having 1 to 18 carbon atoms or an alicyclic hydrocarbon group having 5 or 6 carbon atoms and optionally having a substituent of an alkyl group having 1 to 12 carbon atoms; said Diels-Alder addition product being at least one species selected from the group consisting of (*a*) compounds having the formula of

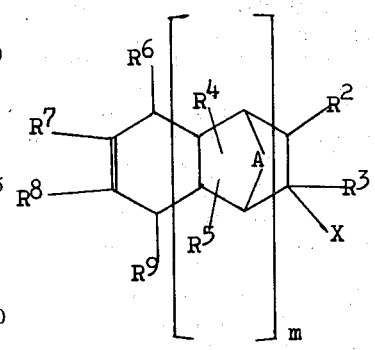

(II)

wherein each of $R^2$, $R^3$, $R^4$ and $R^5$ is a hydrogen atom or methyl group, each of $R^6$, $R^7$, $R^8$ and $R^9$ is a hydrogen atom or alkyl group having 1 to 4 carbon atoms, X is —COOH, —$COOR^a$, —CN or—$CONH_2$, $R^a$ being an alkyl group having 1 to 4 carbon atoms, A is —$CH_2$— or —$CH_2CH_2$—, and *m* is an integer of 1 or 2, and (*b*) compounds having the formula of

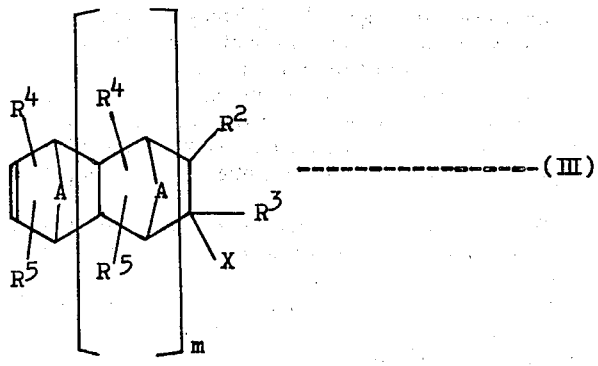

(III)

wherein $R^2$, $R^3$, $R^4$, $R^5$, X, A and *m* are the same as defined above.

The aliphatic alcohols to be used in the invention are those having the above formula (I) and include monovalent acyclic alcohols and monovalent alicyclic alcohols. The acyclic alcohols include primary, secondary or tertiary straight-chain and branched-chain alcohols having 1 to 18 carbon atoms, preferably 4 to 12 carbon atoms. Examples of the aliphatic alcohols to be used are methyl alcohol, ethyl alcohol, propyl alcohol, butyl alcohol, pentyl alcohol, hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, cyclopentyl alcohol, cyclohexyl alcohol, etc. Of these preferable examples are butyl alcohol, pentyl alcohol, hexyl alcohol, heptyl alcohol, octyl alcohol, nonyl alcohol, decyl alcohol, lauryl alcohol, 2-ethylhexyl alcohol, n-octanol-2, tertiary-butyl alcohol, cyclohexyl alcohol, etc.

The Diels-Alder addition products having the formulas (II) and (III) above are known compounds and can be easily prepared. Preferable methods for producing the addition products (II) and (III) are as follows:

(1) Products having the formula (II) in which *m* is 1 can be prepared by Diels-Alder addition reaction of α, β-unsaturated monobasic acid derivatives with conjugated dienes as shown by the following equations:

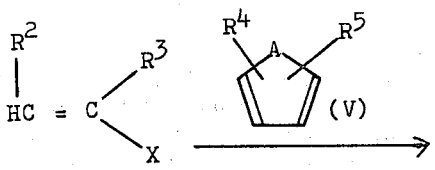

(IV)

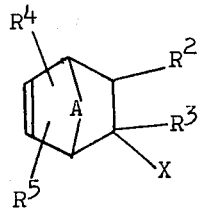

(II')

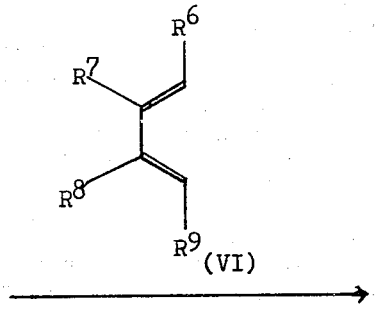

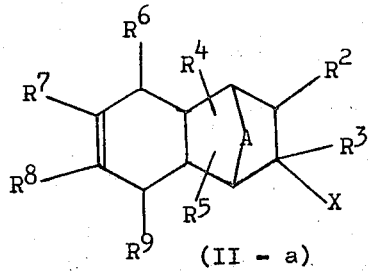

(II - a)

wherein $R^2$ to $R^9$, X and A are the same as defined before.

The Diels-Alder reaction of α, β-unsaturated monobasic acid derivatives (IV) with conjugated cyclic dienes (V) is usually conducted in an open or closed reactor at a temperature of 10° to 250°C, preferably 10° to 200°C. The reaction atmosphere is preferably inert gas atmosphere such as nitrogen, and atmosheric, autogenoous or increased pressure is applicable to the reaction. The α, β-unsaturated monobasic acid derivative (IV) is preferably used in an amount of 0.5 to 2.0 moles per mole of the conjugated diene (V). If necessary, organic solvents such as benzene, toluene, xylene, n-hexane, cyclohexane, etc., can be employed. The reaction is usually completed within 5 minutes to 20 hours in accordance with the reaction conditions applied. The resulting 1 : 1 molar addition product (II') can be separated from the reaction mixture by distilling off the unreacted reactants and solvents, if any. Further, the product (II') itself can be isolated by distillation under reduced pressure.

The addition product thus obtained is then reacted with an acyclic conjugated diene (VI) to produce the desired addition product (II - a) to be used as a starting material of the invention.

The above Diels-Alder reaction is usually conducted in a closed reactor at a temperature of 100° to 300°C, preferably 150° to 250°C. Inert gas atmosphere such as nitrogen is preferable and autogenous or increased pressure is applicable. The conjugated acyclic diene (VI) is used in an amount of 0.5 to 2.0 moles per mole of the addition product (II'). If necessary, organic solvents can be used. The reaction is usually completed within 0.5 to 10 hours depending on the reaction conditions applied. The resulting Diels-Alder addition product (II-a) can be separated from the reaction mixture by distilling off the unreacted reactants and solvents, if any. The product (II - a) can be isolated by distillation under a reduced pressure, if necessary.

(2) Products having the formula (III) in which *m* is 1 can be prepared by 1 : 2 molar Diels-Alder addition reaction of α, β-unsaturated monobasic acid derivatives with conjugated cyclic dienes as shown by the following equation:

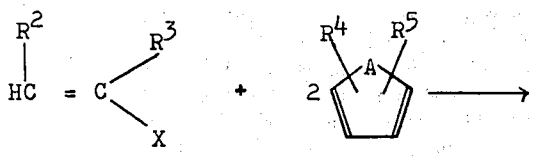

(IV) (V)

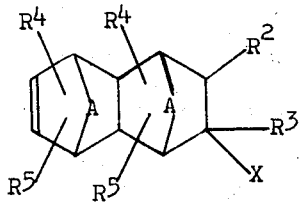

(III - a)

wherein $R^2$ to $R^5$, X and A are the same as defined before.

In this reaction the conjugated cyclic diene (V) is used in an amount of 1.5 to 2.5 moles per mole of the α, β-unsaturated monobasic acid derivative (IV). The reaction conditions are the same as those described in the second step of the method (1) above. The resulting addition product (III - a) can be separated from the reaction mixture by distilling off the unreacted reactants and solvents, if any. The product (III - a) can be isolated by distillation under reduced pressure, if necessary.

(3) Products having the formula (II) in which m is 2 can be prepared by equimolar Diels-Alder addition reaction of addition product (III - a) obtained by the method (2) above with conjugated acyclic dienes as shown by the following equation.

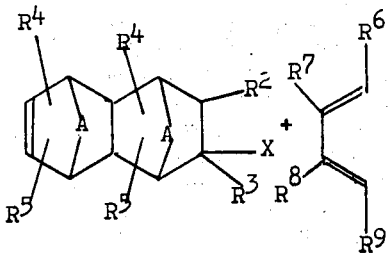

(III - a) (VI)

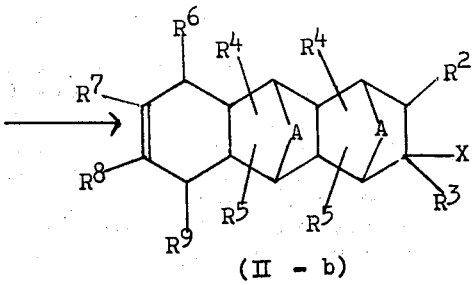

(II - b)

wherein $R^2$ to $R^9$, X and A are the same as defined before.

In this reaction the conjugated acyclic diene (VI) is used in an amount of 0.5 to 1.5 moles per mole of the addition product (III - a). The reaction conditions are the same as those described in the second step of the method (1) above. The resulting reaction product (II - b) can be separated from the reaction mixture by distilling off the unreacted reactants and solvents, if any. The product (II - b) can be isolated by distillation under reduced pressure, if necessary.

(4) Products having the formula (III) in which m is 2 can be prepared by 1 : 3 molar Diels-Alder addition reaction of α, β-unsaturated monobasic acid derivatives (IV) with conjugated cyclic dienes (V) as shown by the following equation:

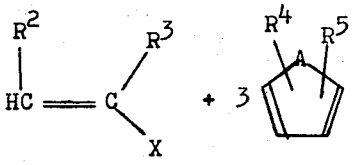

(IV) (V)

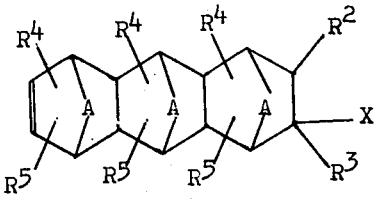

(III - b)

wherein $R^2$ to $R^5$, X and A are the same as defined before.

In this reaction the conjugated cyclic diene (V) is usually used in an amount of 2.5 to 3.5 moles per mole of the α, β-unsaturated monobasic acid derivative (IV). The reaction conditions are the same as those described in the second step of the method (1) above. The resulting product (III - b) can be separated from the reaction mixture by distilling off the unreacted reactants and solvents, if any. The product (III - b) can be isolated by distillation under reduced pressure, if necessary.

A mixture containing two or more of addition products (II - a), (II - b), (III - a) and (III - b) may be prepared by Diels-Alder reaction of products (II') and/or (III - a) with a mixture of cyclic dienes (V) and acyclic dienes (VI).

The $\alpha$, $\beta$-unsaturated monobasic acid derivatives (IV) to be used in the above methods (1) to (4) include, for example, acrylic acid, methacrylic acid, crotonic acid and like $\alpha$, $\beta$-unsaturated monobasic acids, and alkyl esters, nitriles and acid amides thereof. Preferable are methyl acrylate, ethyl acrylate, propyl acrylate, butyl acrylate, methyl methacrylate, ethyl methacrylate, propyl methacrylate, butyl methacrylate, acrylonitrile, etc.

The conjugated dienes to be used include conjugated acyclic dienes (VI) and conjugated cyclic dienes (V). Examples of the former are butadiene, 2-methyl-1,3-butadiene (isoprene), 1,3-pentadiene (piperylene), 2-methyl-1,3-pentadiene, 1,3-hexadiene, 2,4-hexadiene, 2,4-heptadiene, etc. Examples of the latter are cyclopentadiene, methylcyclopentadiene, 1,3-cyclohexadiene, etc. Dimers or codimers of these dienes which produce the corresponding monodienes under the reaction conditions are also employable. Of these, butadiene, isoprene, piperylene, cyclopentadiene, methylcyclopentadiene and dicyclopentadiene are preferable. These conjugated dienes can be used alone or in admixture with one another. For example, petroleum fractions obtained by cracking of naphtha and containing these dienes in mixture can be used for the purpose.

In the Friedel-Crafts reaction to produce the present resin the starting addition products (II) and (III) can be used in a purified form or crude form obtained merely by removing unreacted reactants and solvents, if any, from the Diels-Alder reaction mixture. Preferable addition products are those having the formulas of

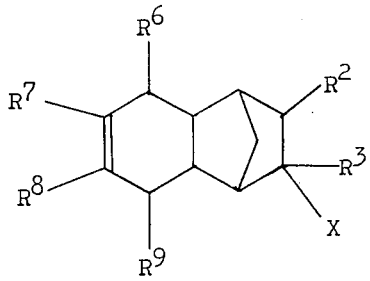

and

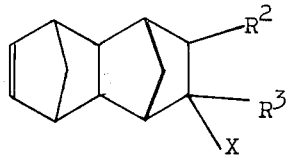

wherein $R^2$, $R^3$, $R^6$ to $R^9$ and X are the same as defined before.

Another starting material, i.e. aliphatic alcohol (I) is used alone or mixed with an equimolar amount of the addition product (II) or (III) to be used. Since the alcohol (I) serves as a solvent in the reaction, it can be employed in a large excess amount, e.g., in 20 moles per mole of the addition product (II) or (III). Preferable amount of the aliphatic alcohol (I) is in the range of 2 to 10 moles per mole of the addition product.

The reaction between the aliphatic alcohol (I) with addition compound (II) or (III) to produce the resin of the invention is carried out in the presence of a Friedel-Crafts catalyst. The Friedel-Crafts catalysts to be used are those conventional in the art and include, for example, hydrogen fluoride, phosphoric acid, sulfuric acid, boron trifluoride, boron trifluoride-etherate, boron trifluoride-phenolate, aluminum trichloride, aluminum tribromide, tin tetrachloride, zinc chloride, activated clay, silica-alumina, etc. Preferable are sulfuric acid, boron trifluoride, boron trifluoride-etherate, boron trifluoride-phenolate and aluminum trichloride. The amount of the catalyst to be used may vary over a wide range depending on the catalyst, starting materials, reaction conditions and the like, but usually it is in the range of 0.05 to 100 wt%, based on the weight of the starting addition product (II) or (III).

The Friedel-Crafts reaction to produce the present resin is carried out in an open or closed reactor at a temperature of 0° to 200°C, preferably at 20° to 150°C. If necessary, the reaction may be conducted in an inert gas atmosphere such as nitrogen. Although increased pressure is applicable, the reaction is usually conducted under atmospheric or autogenous pressures. The reaction is usually completed within 1 to 10 hours.

After the reaction, the catalyst used is inactivated with water, acid or alkali and removed by filtration and/or washing with water. Thereafter, the reaction mixture is distilled to remove unreacted substances and solvents, if any, whereby the present resin is obtained as a residue.

The resin thus obtained is a Friedel-Crafts reaction product of the starting aliphatic alcohol (I) and addition product (II) or (III). It has been found that the aliphatic alcohol (I) is bonded to the addition product (II) or (III) by an ether bond, but the bonded position of the alcohol to the addition product (II) or (III) has not been made clear yet. Further, it has been found that the alcohol (I) is also bonded to the addition product (II) or (III) by an ester bond depending on the kind of the group represented by X contained in the latter. For example, such ester bond is formed by esterification reaction, when X is —COOH, and by ester interchange reaction, when X is —$COOR^a$. The above ester-forming reaction always occurs together with the etherification reaction mentioned above. Therefore, the resin obtained by the present method contains an ether bond and the group represented by X, which is inert to the alcohol, such as —CN or —$CONH_2$, or contains an ether bond and an ester bond. Thus, the resin of the invention may be a mixture of the Friedel-Crafts reaction products mentioned above, but irrespective of the whether it is such mixture or not the resin displays useful properties similar to those of rosin and its derivatives and can be used as a substitute for rosin and its derivatives. Therefore, there is no need to separate these products from one another.

The resin thus obtained is subjected to hydrolysis, if necessary, to produce the resin acid or salt thereof having a carboxyl group neutralized or not neutralized with a base. The hydrolysis can be conducted in a conventional manner. When the resin derived from the addition product having the formula (II) or (III) in which X is —CN, —$COOR^a$ or —$CONH_2$ ($R^a$ being as defined before) is hydrolyzed in the presence of acid, the resin acid having a carboxyl group in the molecule can be obtained. The resin acid salt can be obtained by neutralizing with an alkali a resin acid thus obtained having a free carboxyl group in the molecule. When the hydrolysis is conducted in the presence of a base, moreover, a resin acid salt having a carboxyl group neutralized with the base can be obtained. The base to be used for neutralization includes, for example, sodium hydroxide, potassium hydroxide and like alkali metal hydroxides; ammonia; methyl amine, ethyl amine, propyl amine, butyl amine, hexyl amine, cyclohexyl amine, aniline and like primary amines; dimethyl amine, diethyl amine, dipropyl amine, morpholine, piperidine and like secondary amines; trimethyl amine, triethyl amine, pyridine and like tertiary amines; and monoethanol amine, diethanol amine, triethanol amine, and the like alkanol amines.

The present resin containing a carboxyl group neutralized or not neutralized with base has properties similar to those of rosin or its derivatives.

(1) The present resin containing a carboxyl group is easily dispersible in alkaline aqueous solution to produce an alkaline aqueous dispersion which has both hydrophilic and hydrophobic properties. Therefore, the dispersion displays excellent sizing effect for paper and emulsifying effect. Since the alkaline aqueous dispersion is highly stable, it produces no precipitation during the storage thereof, and the sizing effect and emulsifying effect do not decrease with the passage of time. Particularly, the resin has an aliphatic hydrocarbon group introduced by the ether bond due to the addition of alcohol, and therefore the balance between hydrophobic and hydrophilic properties can be easily adjusted depending on the kind of alcohols used. As a consequence, the resin having desired degree of sizing or emulsifying effect can be obtained selectively.

(2) The resin is excellent in resistance to light and heat, since it has substantially no reactive carbon-carbon double bond in an alicyclic ring due to the addition of alcohol.

(3) The resin is capable of imparting tackiness to various materials and further can be easily modified with alcohols, metal compounds, epoxy compounds or phenolic resins in accordance with the uses to be desired, utilizing reactive carboxyl groups contained therein. Therefore, it can be employed in various uses like rosin or its derivatives, for example, as tackifiers for natural and synthetic rubbers, hotmelt compositions, etc., and resins for paints, printing inks, floor tiles, road marking compositions, etc. Particularly, the resin is improved in plasticity due to the presence of an ether bond.

Moreover, the resin containing a nitrile group represented by X can be modified by converting the nitrile group to amine. This modified resin, like rosin amine, can be used as a polyamide modifying agent, adhesive agent, sterilizing agent, insecticide, antiseptic agent, emulsifying agent and sizing agent for paper making.

For a better understanding of the invention, examples are given below.

EXAMPLE 1

In a 3 liter autoclave were placed 552 g of dicyclopentadiene (8.36 moles calculated as cyclopentadiene), 212 g (4 moles) of acrylonitrile and 300 g of xylene. The air in the autoclave was replaced by nitrogen and the resulting mixture was heated at 200°C for 3 hours to effect the Diels-Alder reaction. After the unreacted substances and xylene were distilled off, the resulting reaction mixture was further distilled under reduced pressure to give 435.5 g of oily addition product as a fraction boiling at 130° to 165°C/5 mm Hg. The addition product thus obtained (hereinafterr referred to as "resin-A") had a molecular weight of 176 (theoretical value 185) and infrared absorption spectra thereof gave absorptions at 2250 $cm^{-1}$ due to —CN and at 715 $cm^{-1}$ due to the double bond of norbornene ring.

In a 1liter four-necked flask equipped with a refluxing condenser, dropping funnel and thermometer were placed 100 g of the resin -A obtained as above and 200 g of lauryl alcohol. To the mixture was added dropwise 19.2 g of boron trifluoride-etherate over 15 minutes. After the addition the mixture was heated at 110°C for 3 hours to effect the Friedel Crafts reaction.

The resulting reaction mixture was cooled and washed with a suturated aqueous solution of sodium carbonate and with water until the mixture became neutral. Removal of the unreacted substance and low-boiling substances by distillation under reduced pressure gave 170.5 g of balsamic resin. Infrared absorption spectra of the resin showed absorptions at 1095 $cm^{-1}$ due to the ether bond and at 2250 $cm^{-1}$ due to the —CN, but the absorption at 715 $cm^{-1}$ due to the double bond of norbornene ring disappeared.

In a 1 liter autoclave were placed 100 g of the resin thus obtained and 303 g of 10 wt.% aqueous solution of potassium hydroxide and the mixture was heated at 200°C for 2 hours for hydrolysis. The resulting mixture was subjected to extraction with ethyl ether to remove unsaponified product and then neutralized with dilute hydrochloric acid. The resulting resin was extracted with ethyl ether and removal of the ethyl ether from the extract gave 76.1 g of balsamic resin having the following properties.

| | | |
|---|---|---|
| Molecular weight | 365 | (Theoretical value: 390) |
| Acid value | 121 | (Theoretical value: 144) |

Infrared absorption spectra of the resin gave absorptions at 1095 $cm^{-1}$ due to ether bond and at 1680 $cm^{-1}$ and 920 $cm^{-1}$ due to carboxyl group.

EXAMPLE 2

The resin-A obtained in Example 1 was subjected to Friedel Crafts reaction in the same manner as in Example 1, except that 150 g of cyclohexylalcohol was used in place of lauryl alcohol. The resulting reaction mixture was treated in the same manner as in Example 1 to obtain 124 g of balsamic resin.

In an autoclave were placed 100 g of the resin thus obtained and 393 g of 10 wt.% aqueous solution of potassium hydroxide and the mixture was heated at 200° C for 2 hours for hydrolysis. The resulting reaction mixture was subjected to extraction with xylene to remove unsaponified product and then neutralized with dilute hydrochloric acid. The neutralized resin was extracted with xylene and removal of xylene from the extract gave 95.7 g of resin having the following properties.

| | | |
|---|---|---|
| Molecular weight | 303 | (Theoretical value: 304) |
| Acid value | 184 | (Theoretical value: 185) |
| Softening point | 61°C | |

EXAMPLE 3

The resin-A obtained in Example 1 was subjected to the Friedel Crafts reaction in the same manner as in Example 1 except that 200 g of n-octanol-2 was used in place of lauryl alcohol. The resulting reaction mixture was treated in the same manner as in Example 1 to obtain 143 g of balsamic resin.

The resin thus obtained was hydrolyzed and neutralized in the same manner as in Example 2, whereby 96.0 g of balsamic resin having the following properties were obtained.

| | | |
|---|---|---|
| Molecular weight | 320 | (Theoretical value: 334) |
| Acid value | 161 | (Theoretical value: 168) |

EXAMPLE 4

206.6 g (2.4 moles) of methyl acrylate was placed in a 1-liter four-necked flask equipped with a reflux condenser, dropping funnel and thermometer and then 184.8 g (2.8 moles) of cyclopentadiene was added thereto dropwise at room temperature over 2 hours. The resulting mixture was heated at 150° C for 1 hour to effect the Diels-Alder reaction. After the unreacted substances were distilled off, the resulting reaction mixture was further distilled under reduced pressure to give 356.2 g of addition product having the following properties as a fraction boiling at 88° to 100°C/21 mm Hg.

| | | |
|---|---|---|
| Molecular weight | 152 | (Theoretical value: 152) |
| Saponification value | 368 | (Theoretical value: 369) |

Infrared absorption spectra of the product gave absorptions at 1730 $cm^{-1}$ and 1040 $cm^{-1}$ due to $—COOCH_3$ and at 715 $cm^{-1}$ due to the double bond of norbornene ring In an autoclave were placed 257 g of the addition product thus obtained and 340 g of a petroleum fraction having the following composition.

| | |
|---|---|
| Trans- 1.3 - pentadiene | 24.5 wt.% |
| Cis- 1.3 - pentadiene | 14.1 wt.% |
| Cyclopentene | 11.4 wt.% |
| Others (free from conjugated dienes) | 50.0 wt.% |

The air in the autoclave was replaced by nitrogen and the mixture was heated at 200° C for 3 hours. After the unreacted substances and low-boiling substances was distilled off, the reaction mixture was further distilled under reduced pressure to obtain 245.2 g of oily resin as a fraction boiling at 120° to 164°C/5 mm Hg. The resin thus obtained (hereinafter referred to as "resin-B") has a molecular weight of 214 (theoretical value: 220) and a saponification value of 246 (theoretical value: 255). Infrared absorption spectra of the resin gave absorptions at 1730 $cm^{-1}$ and 1040 $cm^{-1}$ due to $—COOCH_3$ and at 750 to 800 $cm^{-1}$ due to the double bond of cyclohexene ring.

200 g of 2-ethylhexanol was placed in a 1 liter four-necked flask equipped with a reflux condenser, dropping funnel and thermometer, to which 35 g of 98 wt.% sulfuric acid was added dropwise with stirring at room temperature over 15 minutes. After the stirring was continued for further 15 minutes, 100 g of the resin-B obtained as above was added dropwise to the system at 30° C over 15 minutes. The resulting reaction mixture was heaated at 110° C for 3 hours to effect the Friedel Crafts reaction.

The resulting reaction mixture was washed with water, neutralized with aqueous calcium hydroxide and filtered. Removal of unreacted substances and fractions boiling at temperature lower than 160°C/5 mm Hg gave 153.0 g of an oily resin. Infrared absorption spectra of the resin gave absorptions at 1730 $cm^{-1}$ and 1040 $cm^{-1}$ due to $—COOCH_3$ and at 1095 $cm^{-1}$ due to the ether bond, but absorption at 750 to 800 $cm^{-1}$ due to the double bond of cyclohexene ring disappeared.

To 50 g of the resulting resin heated at 120° C was slowly added dropwise 33.5 g of 48 wt.% aqueous potassium hydroxide, while the methanol produced was distilled off. The temperature of the system was further maintained at 120° C for 2 hours to continue the hydrolysis reaction. After cooling the reaction mixture was subjected to extraction with ethyl ether to remove the unsaponified product and neutralized with dilute hydrochloric acid. The neutralized resin was extracted with ethyl ether and removal of the ethyl ether from the extract gave 43.5 g of balsamic resin having the following properties.

| | | |
|---|---|---|
| Molecular weight | 320 | (theoretical value: 336) |
| Acid value | 159 | (theoretical value: 167) |

Infrared absorption spectra of the resin gave absorptions at 1680 $cm^{-1}$ and 920 $cm^{-1}$ due to the carboxyl group and at 1095 $cm^{-1}$ due to ether bond.

EXAMPLE 5

In a 1 liter four-necked flask was placed 150 g of n-hexyl alcohol, to which 40 g of 98 wt.% sulfuric acid was added dropwise at room temperature over 15 minutes. After the mixture was stirred for a further 15 minutes, 100 g of resin-B obtained in Example 4 was added dropwise at 30°C over 15 minutes. The resulting mixture was heated at 95°C for 2 hours to effect the Friedel Crafts reaction. The resulting reaction mixture was washed with water, neutralized with aqueous potassium hydroxide solution and filtered. Removal of n-hexyl alcohol and fractions boiling below 160° C/5 mm Hg gave 144.0 g of oily resin.

To 100 g of the resulting resin heated at 120° C was added dropwise 72.8 g of 48 wt.% aqueous potassium hydroxide, while the methanol produced was removed. The mixture was further maintained at 120°C for 2 hours. The resulting reaction mixture was subjected to extraction with ethyl ether to remove unsaponified products and neutralized with dilute hydrochloric acid. The neutralized resin was extracted with ethyl ether and removal of ethyl ether from the extract gave 82.5 g of balsamic resin having the following properties.

| | | |
|---|---|---|
| Molecular weight: | 293 | (theoretical value: 308) |
| Acid value: | 173 | (theoretical value: 182) |

EXAMPLE 6

In a 1 liter autoclave were placed 276 g of dicyclopentadiene, 212 g of acrylonitrile and 120 g of xylene. The air in the autoclave was replaced by nitrogen and the resulting mixture was heated at 170°C for 4 hours to effect the Diels-Alder reaction. After the unreacted substances and xylene were distilled off, the resulting reaction mixture was further distilled under reduced pressure to give 453 g of an oily addition product as a fraction boiling at 85° to 90°C/12mm Hg. The addition product thus obtained had a molecular weight of 118 (theoretical value 119).

In a 1 liter autoclave were placed 200 g of the resin obtained as above and 300 g of a petroleum fraction boiling at 20° to 55°C and having the following composition.

| | |
|---|---|
| Cyclopentadiene | 15.7 wt.% |
| Isoprene | 14.1 wt.% |
| Piperilene | 8.4 wt.% |
| Others containing no conjugated dienes | 61.8 wt.% |

The mixture was heated at 200°C for 3 hours. After the unreacted substances were distilled off, the resulting reaction mixture was further distilled under reduced pressure to give 126.5 g of oily resin as a fraction boiling at 120° to 140°C/5 mm Hg. The molecular weight of the resin was 205.

In a 1 liter four-necked flask equipped with a reflux condenser, dropping funnel and thermometer were placed 100 g of the oily resin thus obtained and 200 g of n-octyl alcohol. To the mixture was added dropwise 19.5 g of boron trifluoride-etherate at room temperature over 15 minutes. After the addition the mixture was heated at 110° C for 3 hours to effect the Friedel Crafts reaction.

The resulting mixture was cooled and washed with a saturated aqueous solution of sodium carbonate and further with water until the mixture became neutral. Removal of the unreacted alcohol and low-boiling substances by distillation under reduced pressure gave 157 g of balsamic resin.

In a 1 liter autoclave were placed 100 g of the resulting resin and 303 g of 10 wt.% aqueous potassium hydroxide and the mixture was heated at 200°C for 2 hours for hydrolysis. The resulting reaction mixture was subjected to extraction with ethyl ether to remove the unsaponified product and neutralized with dilute hydrochloric acid. The neutralized resin was extracted with ethyl ether and removal of the ethyl ether from the extract gave 96.0 g of balsamic resin. The resin had an acid value of 160.5.

EXAMPLE 7

In a 1 liter autoclave were placed 110 g of methyl ester of the 8-carboxytetracyclo-[4,4,$1^{2.5/7.10}$, $0^{1.6}$] dodecene -3, 48 g of dicyclopentadiene and 200 g of xylene. The air in the autoclave was replaced by nitrogen and the mixture was heated at 220° C for 3 hours. After xylene and the low-boiling substances boiling at below 160°C/5 mm Hg were distilled off, the resulting reaction mixture was further distilled under reduced pressure to give 65 g of a waxy resin boiling at 165° to 195°C/5 mm Hg. The resin had a molecular weight of 308 (theoretical value 284).

In a one-liter four-necked flask were placed 50 g of the resulting resin and 150 g of n-butyl alcohol. To the mixture was added dropwise 5 g of boron trifluoride-etherate at 50° C over 15 minutes, and the resulting mixture was heated at 110°C for 3 hours for the Friedel Crafts reaction.

The resulting reaction mixture was cooled and washed with a saturated aqueous solution of calcium carbonate and further with water until the mixture became neutral. Removal of the unreacted alcohol gave 61.3 g of balsamic resin. To 50 g of the resulting resin heated to 120° C was added dropwise 32.7 g of 48 wt.% aqueous potassium hydroxide over 30 minutes. While adding water gradually and removing the methyl alcohol produced, the hydrolysis was conducted for 2 hours. The resulting reaction mixture was subjected to extraction with ethyl ether to remove the unsaponified product and neutralized with dilute hydrochloric acid. The resin was extracted with ethyl ether and removal of ethyl ether from the extract gave 41.0 g of the resin having the following properties:

| | | |
|---|---|---|
| Molecular weight | 375 | (theoretical value: 344) |
| Softening point | 65.0°C | |
| Acid value | 171.8 | (theoretical value: 163.0) |

The resins obtained in the above examples were tested in respect of their applications as sizing compositions and as emulsifiers for emulsion polymerization of synthetic rubber according to the following methods With the results given below.

Each of the resins of Examples 1 to 7, rosin and fortified rosin was neutralized with potassium hydroxide in an equimolar amount relative to the acid value of the resin to prepare a 25 wt.% aqueous solution thereof.

1. Sizing composition and sizing effect

Each of the compositions obtained above was used as a sizing agent for paper making. A specified amount of the sizing composition was added to a 1 wt.% slurry of pulp (LBKP) having a beating degree of 30°SR. An aqueous solution of aluminum sulfate was further added to and uniformly dispersed in the slurry in a solid amount of 2.5 wt.% based on the dry pulp. Using a TAPPI Standard Sheet Machine, the resulting slurry was made at 20°C into paper weighing 60 ± 1 g/m². The paper was dried at 100° C for 5 minutes and conditioned at 20° C and 65% RH. The sizing effect given to the paper was determined according to Stöckigt method (JIS P 8122).

Table 1

| Sizing composition No. | Resin | Sizing effect in seconds Amount used (wt.%)* 0.3 | 0.5 |
|---|---|---|---|
| 1 | Example 1 | 19.5 | 25.2 |
| 2 | Example 2 | 21.2 | 23.8 |
| 3 | Example 3 | 23.8 | 28.5 |
| 4 | Example 4 | 20.8 | 26.2 |
| 5 | Example 5 | 24.2 | 29.3 |
| 6 | Example 6 | 21.5 | 26.0 |
| 7 | Example 7 | 20.8 | 27.2 |
| 8 | Rosin | 17.6 | 24.8 |
| 9 | Fortified rosin | 22.3 | 27.5 |

*The amount of sizing composition is percent in solid weight, based on the pulp.

2. Emulsifying composition

Each of the aqueous compositions of the resin obtained in Examples 1 to 5 was used as an emulsifier for emulsion polymerization according to the cold rubber sulfoxylate formulation shown in Table 2 to obtain SBR. The conversion and stability of latex are respectively shown in Tables 3 and 4.

Table 2

| Materials used | Names of materials used | Proportions parts by weight |
|---|---|---|
| Monomer | Butadiene | 70 |
| | Styrene | 30 |
| Dispersing medium | Deionized water (degassed) | 200 |
| Emulsifier | Aqueous solution of resin of Examples (as solid) | 4.0 |
| | Naphthalene-formaldehyde resin sodium sulfonate | 0.15 |
| Molecular weight adjusting agent | Tertiary dodecylmercaptan | 0.1 |
| Polymerization initiator | | |
| Oxidizing agent | p-Menthane hydroperoxide | 0.08 |
| Reducing agent | Ferrous sulfate (heptahydrate) | 0.0125 |
| Secondary reducing agent | Sodium formaldehyde sulfoxylate | 0.15 |
| Chelating agent | EDTA — 4Na | 0.07 |
| Electrolyte | Sodium phosphate (dodecahydrate) | 0.8 |

Polymerization conditions

Polymerization temperature : 5°C.
Reaction time : 9 hours.
In nitrogen atmosphere.

Conversion

Table 3 gives the percent conversion of the products of the various preceding examples. It also includes a comparison with a commercial disproportionated resin emulsifier under the same conditions.

Table 3

| Emulsifier | Conversion (%) |
|---|---|
| Example 1 | 56.4 |
| Example 2 | 57.6 |
| Example 3 | 67.3 |
| Example 4 | 56.3 |
| Example 5 | 68.5 |
| Commercial disproportionated rosin emulsifier | 65.1 |

Stability test of latex 50 g of 25 wt.% an aqueous solution of the latex obtained in the above polymerization was placed in a container and subjected to mechanical shearing force at a temperature of 25°C for 5 minutes, under a load of 5 kg and at a rotational speed of 1000 r.p.m. The resulting coagulate was filtered through an 80-mesh stainless screen and dried to determine the percent of coagulate formed.

$$\text{Coagulate formed (\%)} = \frac{\text{Weight of coagulate dried}}{12.5} \times 100$$

The smaller the percent of coagulate formed, the more stable is the latex.

Table 4 shows the result in comparison with that obtained with the use of the commercial disproportionated rosin emulsifier.

Table 4

| Emulsifier | Coagulate formed (%) |
|---|---|
| Example 1 | 1.5 |
| Example 2 | 0.4 |
| Example 3 | 0.5 |
| Example 4 | 1.2 |
| Example 5 | 0.6 |
| Commercial disproportionated resin emulsifier | 0.4 |

What we claim is:

1. A process for manufacturing novel resin which consists essentially of reacting in the presence of Friedel-Crafts catalyst a Diels-Alder addition product with an aliphatic alcohol having the formula of $R^1OH$ wherein $R^1$ is an aliphatic straight-chain or branched-chain saturated hydrocarbon group having 1 to 18 carbon atoms or alicyclic hydrocarbon group having 5 or 6 carbon atoms and having or not having a substituent of an alkyl group having 1 to 12 carbon atoms; said Diels-Alder addition product being at least one species selected from the group consisting of (*a*) compounds having the formula of

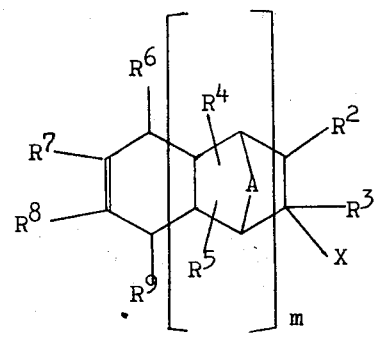

wherein each of $R^2$, $R^3$, $R^4$ and $R^5$ is a hydrogen atom or methyl group, each of $R^6$, $R^7$, $R^8$ and $R^9$ is a hydrogen atom or alkyl group having 1 to 4 carbon atoms, X is —COOH, —$COOR^a$, —CN or $CONH_2$, $R^a$ being an alkyl group having 1 to 4 carbon atoms, A is —$CH_2$— or —$CH_2CH_2$—, and *m* is an integer of 1 or 2, and (*b*) compounds having the formula of

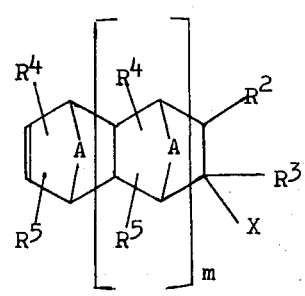

wherein $R^2$, $R^3$, $R^4$, $R^5$, X, A and *m* are the same as defined above.

2. A process according to claim 1 wherein said catalyst is present in an amount of 0.05% to 100% by weight based on said addition product, and the reaction is carried out at a temperature of 0° to 200°C.

3. A process according to claim 2 in which said Diels-Alder addition product has the formula of

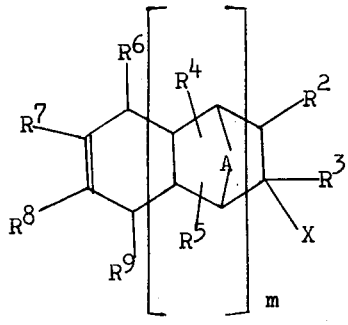

wherein each of $R^2$, $R^3$, $R^4$ and $R^5$ is a hydrogen atom or methyl group, each of $R^6$, $R^7$, $R^8$ and $R^9$ is a hydrogen atom or alkyl group having 1 to 4 carbon atoms, X is —COOH, —$COOR^a$, —CN or —$CONH_2$, $R^a$ being an alkyl group having 1 to 4 carbon atoms, A is —$CH_2$— or —$CH_2CH_2$—, and *m* is an integer of 1 or 2.

4. A process according to claim 2 in which said Diels-Alder addition product has the formula of

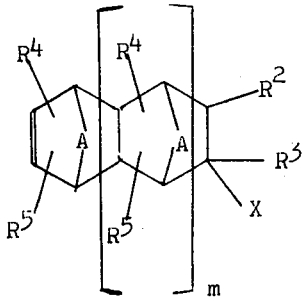

Wherein each of $R^2$, $R^3$, $R^4$ and $R^5$ is a hydrogen atom or methyl group, X is —COOH, —$COOR^a$, —CN or —$CONH_2$, $R^a$ being an alkyl group having 1 to 4 carbon atoms, A is —$CH_2$— or —$CH_2CH_2$—, and *m* is an integer of 1 or 2.

5. A process according to claim 2 in which said *m* is 1.

6. A process according to claim 2 in which said *m* is 2.

7. A process according to claim 3 in which said $R^2$ to $R^5$ are hydrogen atoms, A is —$CH_2$— and *m* is 1.

8. A process according to claim 4 in which said $R^2$ to $R^5$ are hydrogen atoms, A is —$CH_2$— and *m* is 1.

9. A process according to claim 2, in which said aliphatic alcohol is an aliphatic acyclic alcohol having a straight-chain or branched-chain hydrocarbon group of 4 to 12 carbon atoms.

10. A process according to claim 2, in which said aliphatic alcohol is an alicyclic alcohol having alicyclic hydrocarbon group of 5 6 carbon atoms.

11. A process according to claim 2, in which said X is —$COOR^a$, —CN or —$CONH_2$, $R^a$ being an alkyl group having 1 to 4 carbon atoms, and the resulting resin is hydrolyzed to produce a resin acid.

12. A process according to claim 2, in which said X is —COOH and the resulting resin is neutralized with a a base to produce a resin acid salt.

13. A resin obtained by the method claimed in claim 2 and an alkali salt thereof.

14. A process according to claim 2 wherein X is COOH or $COOR^a$.

15. A process according to claim 14 comprising reacting X with a base whereby a resin acid salt is produced.

16. A process according to claim 14 wherein X is $COOR^a$.

17. A process according to claim 11 wherein X is $COOR^a$.

18. The product of the process of claim 14.

19. The product of the process of claim 15.

20. The product of the process of claim 16.

21. The product of the process of claim 17.

22. A process according to claim 2 wherein said reaction is carried out for a period of 1 to 10 hours.

23. A process according to claim 2 wherein the reaction is carried in an inert atmosphere.

24. A process according to claim 12 wherein said base is taken from the class consisting of alkali metal hydroxides primary amines, secondary amines, tertiary amines, and alkanol amines.

25. A process according to claim 24 wherein said base is taken from the class consisting of sodium hydroxide, potassium hydroxide, ammonia, methyl amine, ethyl amine, propyl amine, butyl amine, hexyl amine, cyclohexyl amine, aniline, dimethyl amine, diethyl amine, dipropyl amine, morpholine, piperidine, trimethyl amine, triethyl pyridine, monoethanol amine, diethanol amine, and triethanol amine.

* * * * *